United States Patent [19]

Stull

[11] Patent Number: 4,651,886

[45] Date of Patent: Mar. 24, 1987

[54] SCREW CAP WITH SEALING LINER

[76] Inventor: Gene Stull, 5 Oak St., Chester, N.J. 07930

[21] Appl. No.: 885,284

[22] Filed: Jul. 14, 1986

[51] Int. Cl.[4] ..... B65D 53/04

[52] U.S. Cl. ..... 215/329; 215/350

[58] Field of Search ..... 215/350, 329

[56] References Cited

U.S. PATENT DOCUMENTS

| | | | |
|---|---|---|---|
| 653,610 | 7/1900 | Bernardin | 215/350 X |
| 1,844,442 | 2/1932 | Schmalz | 215/329 |
| 2,039,757 | 5/1936 | Vontill | 215/350 X |
| 2,681,742 | 6/1954 | Miller | 215/350 |
| 3,595,419 | 7/1971 | Dukess | 215/350 X |
| 3,917,100 | 11/1975 | Dukess | 215/329 |

*Primary Examiner*—Donald F. Norton

*Attorney, Agent, or Firm*—H. Gibner Lehmann; K. Gibner Lehmann

[57] ABSTRACT

A screw cap and sealing liner construction including a cap body having a transverse top wall with an inside surface, and having an annular skirt depending from the top wall, the annular skirt having an internal screw thread which extends upward and has a top end located closely adjacent the inside surface. A sealing liner is disposed immediately below and against the inside wall surface, and has a peripheral portion located between this surface and the top end of the screw thread to be engaged and positioned thereby. A nib is provided on the inside of the annular skirt at a location circumferentially spaced from the top end of the screw thread. The nib is adjacent the inside surface of the top wall and engages the underside of the sealing liner to retain the liner in position below this surface. The arrangement simplifies both the molding of the cap and the stripping of the cured part from the mold.

5 Claims, 2 Drawing Figures

SCREW CAP WITH SEALING LINER

Research and development of the present invention and application have not been Federally-sponsored, and no rights are given under any Federal program.

BACKGROUND OF THE INVENTION

FIELD OF THE INVENTION

This invention relates to screw caps constituted of molded plastic, and more particularly to caps of the type incorporatin a captive sealing liner which is engaged and compressed by the lip of a container so as to form a seal when the cap is assembled thereto.

DESCRIPTION OF THE RELATED ART INCLUDING INFORMATION DISCLOSED UNDER 37 CFR §§1.97–1.99

U.S. Pat. No. 2,039,757 illustrates a molded cap construction wherein a sealing liner is retained against the inner surface of the transverse top wall of the cap by means of a semicircular ledge extending through an angle of somewhat more than 180 degrees. The specification indicates that an arc of twothirds of a circle has been found to be satisfactory. The statement is made that as long as the ledge extends more than half way around the circumference of the cap, the liners will be retained in position. In all of the constructions disclosed in this patent, the top end of the thread terminates at a point which is axially below the location of the ledge.

U.S. Pat. No. 1,844,442 illustrates a different construction wherein a screw cap having a cylindrical recess adjacent its top wall is provided with radially inwardly projecting fine thread formations that frictionally retain the liner. These formations are disposed above and separate from the main cap threads that normally engage the cooperable threads of the container with which the cap is employed.

U.S. Pat. No. 3,917,100 shows a cap having an annular groove at the inner surface of the top wall. The liner is pressed into this groove and permanently retained therein.

Other caps incorporating liners are illustrated in U.S. Pat. Nos. 653,610; 2,681,742; and 3,595,419.

Still other liner retention methods have been employed, such as the application of adhesives or glues to the liners in order to retain them in their intended positions.

One of the considerations that must be taken into account is that the size of the liner must be at least as large as the outer part of the lip of the container so that the desired seal can be effected. In addition it is important that the structure employed to retain the liner not interfere with the container lip when the cap is assembled or removed.

In prior constructions employing retention grooves adjacent the inner surface of the top wall of the cap, problems often occurred with assembly of the liner, as well as with molding of the cap. During installation of the liner it was usually necessary to compress the edges to a considerable extent and to force them past the projecting wall forming the lower part of the retention groove. Such momentary deformation sometimes damaged the liner and rendered it unuseable as a seal. In addition, where the caps were molded as a single piece it was often difficult to strip the cured cap part from the mold because of the presence of this projecting wall which was underlying the larger-diameter mold part.

Damage to either this wall or the threads could result if sufficient care was not exercised in carrying out such stripping operations.

In order to circumvent problems such as this many manufacturers have resorted to molding internal cap threads in such a way that they extend completely up to and merge with the inner surface of the cap top wall. By so doing, it is possible to "unscrew" the cured cap from the mold, as a nut would be removed from a machine screw. Forcible stripping is thus avoided. However, under such circumstances there is no provision for retention of a liner, other than resorting to adhesives, etc. This approach has been found to be unsatisfactory in many instances.

SUMMARY OF THE INVENTION

The above disadvantages and drawbacks of prior screw cap constructions of the type having captive liners are largely obviated by the present invention, which has for one object the provision of a novel and improved liner-retention type screw cap which is extremely simple in its structure and economical to manufacture and produce.

A related object of the invention is to provide an improved screw cap as above set forth wherein molding is facilitated, and wherein stripping of the cured cap part from the mold is simplified without sacrifice of the capability of permanently retaining a cap liner in a reliable manner.

Still another object of the invention is to provide an improved screw cap as above characterized wherein there is minimized momentary deformation of the liner as it is being inserted into the cap, thereby reducing the likelihood of damage occurring thereto and minimizing problems with resulting poor or inadequate seals between the cap and container.

Yet another object of the invention is to provide an improved liner-retention type screw cap which can be molded as a single piece and wherein the mold configuration is greatly simplified as compared with prior molds incorporating other types of liner retention structures.

The above objects are accomplished by a unique screw cap and sealing liner construction, comprising in combination a cap body having a transverse top wall with an inside surface, and having an annular skirt depending from the top wall, the annular skirt having an internal screw thread which extends upward and has a top end located closely adjacent the inside surface. A sealing liner is disposed against the inside surface, and has a peripheral portion located between this surface and the top end of the screw thread to be engaged and positioned thereby. A special liner-retention nib which is cooperable with the top end of the screw thread is provided on the inside of the annular skirt at a location circumferentially spaced from the top end of the thread. The nib is adjacent the inside surface of the top wall and in conjunction with the thread end, engages the underside of the sealing liner to retain the liner in position against this surface. The arrangement simplifies molding of the cap as well as stripping of the cured cap part from the mold.

The relatively small size of the nib minimizes the amount of deformation of the liner necessitated during insertion thereof. Also, it has been determined that the retention provided on the one hand by the top end of the thread, and on the other hand by the nib, is completely satisfactory from the standpoint of eliminating inadvertent loss or falling out of the liner. The construction is characterized by reliability and good sealing capability.

Other features and advantages will hereinafter appear.

BRIEF DESCRIPTION OF THE DRAWINGS

In the drawings, illustrating a preferred embodiment of the invention.

DESCRIPTION OF THE PREFERRED EMBODIMENT

Figure 1:
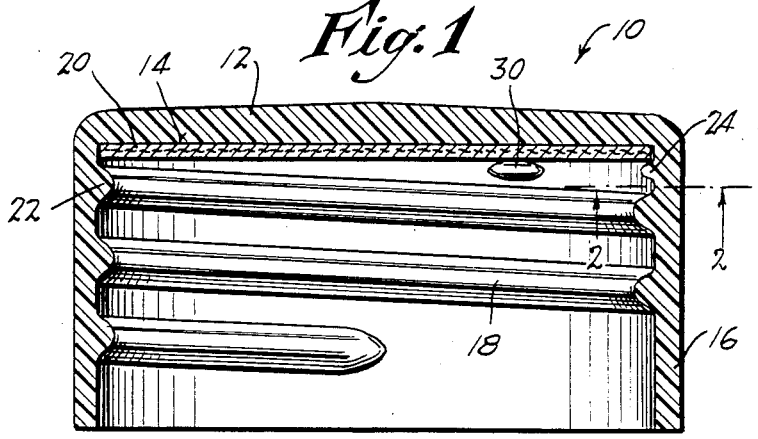
FIG. 1 is an axial section of the improved screw cap incorporating the novel liner retention structure as embodied by the present invention.
Figure 2:
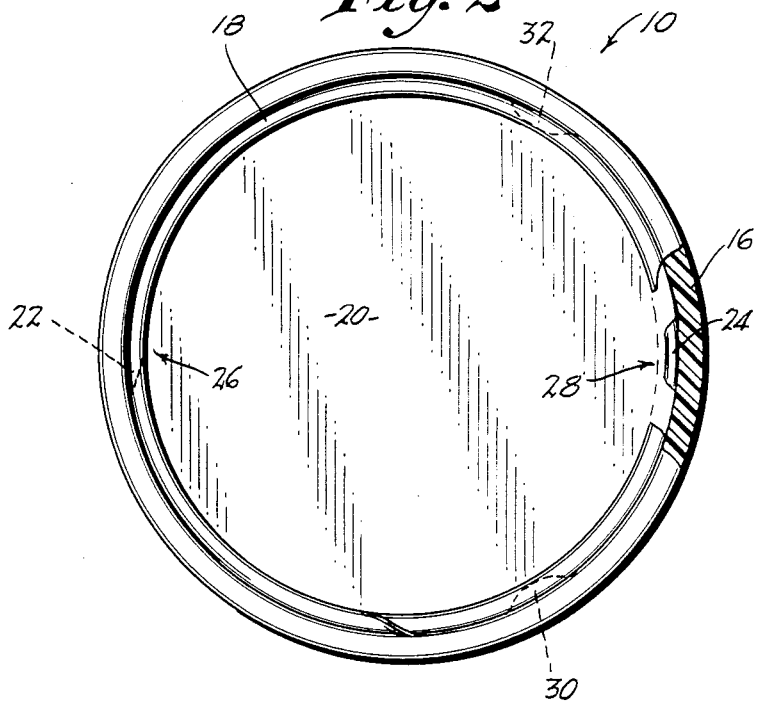
FIG. 2 is a view, partly in bottom plan and partly in fragmentary section, of the screw cap of FIG. 1, the section being taken on the line 2—2 of FIG. 1.

Referring to FIGS. 1 and 2 there is illustrated a screw cap construction having a cap body generally designated by the numeral 10 and comprising a transverse top wall 12 with an inside surface 14, and an annular skirt 16 depending from the top wall 12. The skirt has internal screw threads 18 as shown.

In accordance with the present invention there is provided a novel and improved arrangement for permanently retaining a circular sealing cap liner 20 against the inner surface 14 of the transverse top wall 12. In accomplishing this, the top end 22 of the internal screw thread 18 is made to terminate at a location spaced a short distance from the inner surface 14. The circular space between the top end of the thread and the inner surface is referred to as a liner head space, having a generally disk-like configuration and being of a size that enables it to snugly receive the cap liner 20 as shown.

Also by the invention, there is provided at a point circumferentially spaced from the top end of the thread, a radially inwardly projecting nib 24. The nib 24 is spaced axially downward from the inner surface 14 by a distance that is commensurate with the thickness of the liner 20. As the liner 20 is pressed into position, it is momentarily deformed as it by-passes the top end 22 of the thread and the nib 24. Thus following its installation, the liner is engaged at a first point 26 by the top end 22 of the thread, and at a second point 28 by the nib 24, and is thereby securely held against axial dislodgement. Since the nib 24 is preferably disposed generally opposite to the location of the top end 22 of the thread, the liner 20 is permanently retained at two diametrically opposite peripheral points 26 and 28. FIGS. 1 and 2 illustrate two additional nibs 30, 32 that can optionally be incorporated in the cap body 10 if desired, for additional retention.

It is to be noted that the resilience of the material of which the cap is molded enables the cured part to be stripped axially from the mold, as opposed to being "unscrewed". During such stripping, the threads 18 of the cap body by-pass the mold cavity threads (not shown), and the nibs 24, 30, 32 similarly by-pass the walls of the recesses in the mold cavities that form them. This stripping operation can be accomplished relatively easily, and with little likelihood of damage occurring to either the threads or nibs.

The present construction has the following important advantages. First, the configuration of the mold cavity is greatly simplified as compared to many of the prior molds that were employed to fabricate screw caps of the type incorporating sealing liners. Second, the relatively small size of the nibs simplifies stripping, as noted above. Also, insertion of the liner is simplified since the momentary deformation that is required occurs generally along short diametrically opposite points of the circular liner 20, as opposed to prior constructions incorporating full or partially circular ledges. In the latter instance, most or all of the periphery of the liner had to be compressed radially inwardly at multiple points. All too often this procedure resulted in permanent damage to the liner, causing poor seating, unsatisfactory sealing characteristics, or at worst, distortion of the liner to the extent that it was rendered unuseable.

I have found that the retention of the liner essentially at two diametrically opposed points 26, 28 as outlined above provides both a simple and an effective seal; during liner insertion, the interference that occurs between the diametrically opposed points of the liner and the thread and nib does not materially adversely affect the functioning of the liner. The screw cap and retention arrangement of the present invention are thus seen to represent a distinct advance and improvement in the closure field.

Variations and modifications are possible without departing from the spirit of the invention.

Each and every one of the appended claims defines an aspect of the invention which is separate and distinct from all others, and accordingly it is intended that each claim be treated as such when examined in the light of the prior art devices in any determination of novelty or validity.

What is claimed is:

1. A screw cap and sealing liner construction comprising, in combination:

(a) a cap body having a transverse top wall with an inside surface, and having an annular skirt depending from the top wall, (b) said annular skirt having an internal screw thread which extends upward and has a top end located closely adjacent the inside surface of the top wall, (c) a sealing liner in said cap body, disposed immediately below the inside surface of said top wall, (d) said sealing liner having a peripheral portion located between said inside surface and the top end of said screw thread for engagement therewith to be positioned thereby, and (e) a nib on the inside of said annular skirt at a location circumferentially spaced from the top end of the screw thread, (f) said nib being adjacent the inside surface of the top wall and engaging the underside of said sealing liner to retain the liner in position below said inside surface.

2. The invention as set forth in claim 1, wherein:

(a) the distance between the nib and the inside surface of the top wall is substantially the same as the thickness of the sealing liner, so as to firmly retain the latter in position.

3. The invention as set forth in claim 1, wherein:

(a) the nib is spaced circumferentially substantially diametrically opposite the location of the top end of the screw thread.

4. The invention as set forth in claim 1, and further including:

(a) an additional nib on the inside of the annular skirt, circumferentially spaced from the first nib and the top end of the screw thread.

5. The invention as set forth in claim 1, wherein:

(a) the inside surface of the top wall and the top end of the thread and the nib define a disk-like liner retention head space, (b) said liner being retained in said head space by said nib and thread.

* * * * *